US005485813A

United States Patent [19]

Molitor et al.

[11] Patent Number: 5,485,813

[45] Date of Patent: Jan. 23, 1996

[54] LOST MOTION ACTUATOR WITH DAMPING TRANSITION

[75] Inventors: Mark R. Molitor, Muskegon, Minn.; James T. Robnett, Royal Oak, Mich.

[73] Assignee: Siemens Automotive Corporation, Auburn Hills, Mich.

[21] Appl. No.: 371,250

[22] Filed: Jan. 11, 1995

[51] Int. Cl.[6] ..... F01L 1/16

[52] U.S. Cl. ..... 123/90.12; 123/90.16; 123/90.49

[58] Field of Search ..... 123/90.12, 90.13, 123/90.15, 90.16, 90.48, 90.49, 90.52, 90.55

[56] References Cited

U.S. PATENT DOCUMENTS

| | | | |
|---|---|---|---|
| 4,615,306 | 10/1986 | Wakeman | 123/90.16 |
| 4,889,085 | 12/1989 | Yagi et al. | 123/90.12 |
| 5,088,458 | 2/1992 | Wakeman et al. | 123/90.49 |
| 5,158,048 | 10/1992 | Robnett et al. | 123/90.12 |
| 5,216,988 | 6/1993 | Taxon | 123/90.12 |
| 5,233,951 | 8/1993 | Hausknecht | 123/90.16 |
| 5,255,639 | 10/1993 | Shirey et al. | 123/90.16 |
| 5,275,136 | 1/1994 | Schechter et al. | 123/90.12 |

*Primary Examiner*—Henry C. Yuen
*Assistant Examiner*—Weilun Lo
*Attorney, Agent, or Firm*—Russel C. Wells

[57] ABSTRACT

A lost motion hydraulic actuator for use between a cam and a valve of an internal combustion engine is provided with internal communication ports that are controlled by a piston to provide sequential closing of the ports during closing of the engine valve to reduce hydraulic shock and hammering noise as fluid is gradually directed exclusively through a damping orifice during valve seating.

8 Claims, 2 Drawing Sheets

LOST MOTION ACTUATOR WITH DAMPING TRANSITION

FIELD OF THE INVENTION

This invention relates to lost motion hydraulic actuators for use between a cam and a valve of an internal combustion engine for controlling actuation of the valve, preferably in connection with an electronic valve timing system.

BACKGROUND OF THE INVENTION

It is known in the art to use a lost motion hydraulic actuator for transmitting cam motion to a valve of an internal combustion engine, to vary the valve timing through electronic solenoid control of fluid exhaust from the actuator, and to provide hydraulic damping of the valve seating action through temporary restriction of hydraulic flow. The structure and operation of two such actuator embodiments are disclosed in detail in U.S. Pat. Nos. 5,158,048 Robnett et al. issued Oct. 27, 1992, and 5,216,988 Taxon issued Jun. 8, 1993, both assigned to the assignee of the present invention. The disclosures of both these patents are hereby incorporated by reference in this disclosure.

In these prior mechanisms, the damping device, comprising a sharp-edged orifice, is fully effective only after closing of a free flow fluid path, including communication ports which are closed by a valve driven piston upon closing motion of the engine valve to near the point of seating. In some instances, some hydraulic hammering noise has been observed in operation, apparently due to the rapid change in hydraulic flow rate that occurs during the change from free flow, when the communication ports are open, to damped flow, when these ports have been cut off. Improved arrangements to reduce the occurrence of hydraulic hammer shock and noise are desired.

SUMMARY OF THE INVENTION

The present invention provides an improved lost motion hydraulic actuator designed to reduce the effects of hydraulic hammer. In one embodiment, a plurality of communication ports are included in the free flow fluid path between a valve piston chamber and a cam piston chamber. To reduce the rate of change of fluid flow, the ports may be axially staggered so that the piston closes the ports sequentially instead of all at once, thus changing the fluid flow rate incrementally as the system is changed from free flow to full damping. Alternatively, the form of the piston wall or leading edge thereof may be modified to intercept the ports sequentially, even though the ports are not axially staggered, by modifying the piston skirt to have an axially varying, or sculpted, control end.

These and other features and advantages of the invention will be more fully understood from the following description of an exemplary embodiment of the invention taken together with the accompanying drawings.

DETAILED DESCRIPTION OF THE INVENTION

Figure 1:
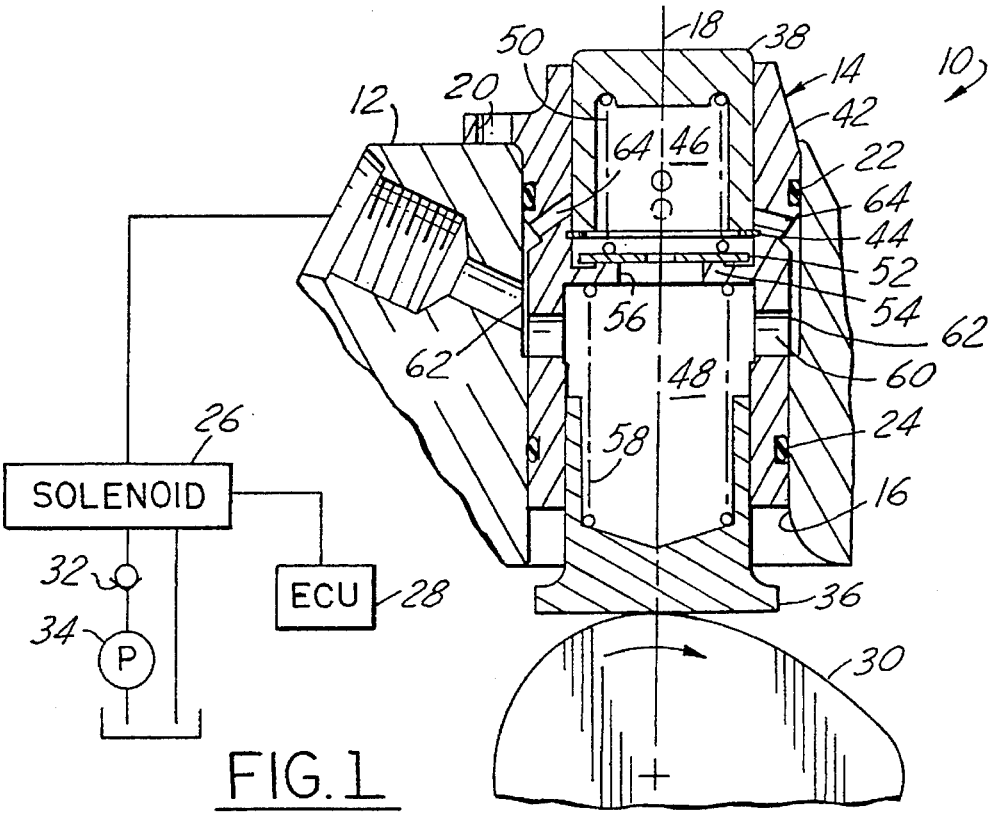
FIG. 1 is a cross-sectional view of one embodiment of hydraulic actuator according to the invention shown riding on the base circle of a timing cam in an engine with an oil supply and control system shown partially schematically.

Referring now to FIGS. 1–4 of the drawings in detail, numeral 10 generally indicates an internal combustion engine having a component, such as a cylinder head 12, mounting a lost motion hydraulic actuator formed according to one embodiment of the invention and generally indicated by numeral 14. The fundamental operation of a hydraulic actuator in an internal combustion engine for controlling the opening and closing of the engine valves is well known and will not be detailed here.

The actuator 14 may be mounted in a bore 16 centered on an axis 18 in the cylinder head 12 of the engine. It is retained there by means of fasteners such as bolts, not shown, passing through clearance holes 20 in the actuator 14 and threaded into the cylinder head. At least two seal members 22, 24 are located around the outside diameter of the actuator 14 to control or prevent leakage of the hydraulic fluid from between the actuator 14 and the bore 16 and into the various volumes in the cylinder head and the engine. The hydraulic fluid in most installations is engine oil.

Control of the hydraulic fluid is by means of a solenoid actuated valve 26 controlled by an electronic valve timing control unit or ECU 28. The solenoid actuated valve 26 is operated to control the flow of the hydraulic fluid to and from the actuator 14 in a manner as described in U.S. Pat. No. 4,615,306. This is one of several patents describing an electronic valve timing, EVT system. While an EVT system cannot create more valve motion, it can reduce the valve motion created by the timing cam 30. The EVT system can be programmed to allow standard or full valve lift down to zero valve lift in any increment.

As illustrated, a one-way valve 32 controls the flow of fluid from a pump 34 to the cylinder head 18. In its most simplistic operation, when the solenoid valve 26 is opened, the hydraulic fluid flows into the actuator 14 to maintain the proper amount of fluid therein and to maintain the pressure of the fluid. When the solenoid valve 26 is closed, the fluid is trapped in the actuator 14 forming a "solid fluid link" that functions to operate the actuator 14 by having a lower cam actuated piston 36 solidly connected by the fluid link to an upper valve actuating piston 38 so that both reciprocate together.

Upper piston 38 is operatively connected to an engine valve, not shown, of the engine 10. Typically the engine valve is biased closed by means of a valve spring, not shown, which also functions to bias the upper piston 38 down toward its lower, valve closed, position as will herein be described. Therefore, when the solenoid valve 26 is opened during a time when the engine valve is open or being opened, hydraulic fluid, under the pressure of the valve spring flows back to the oil supply 40. The ECU 28 receives various signals from several engine sensors, not shown, and according to predetermined conditions controls operation of the solenoid actuated valve 26.

The upper piston 38 is slidably located for reciprocating motion in a bypass sleeve 42 centered on the axis 18. In its lower position, the upper piston 38 rests on or near a shoulder or snap ring 44 as illustrated in FIG. 1. The bypass sleeve 42, in cross-section as indicated in FIG. 1, is shaped like an "H" with the upper piston 38 located in an upper (valve) chamber 46 above the cross bar of the "H" and the lower piston 36 located in a lower (cam) chamber 48 below the cross bar of the "H". Both pistons 36, 38 are located along the central axis 18 of the bypass sleeve 42. In the upper chamber 46 there is located an upper spring 50 which biases the upper piston 38 away from the cross bar. The upper spring 50 is supported at one end by means of an orifice plate 52 resting on a support ring 54 formed in the cross bar and is located against the bottom of an annular recess in the upper piston 38.

Located axially in the cross bar, is a chamber passage 56 allowing the flow of fluid between the upper 46 and lower 48 chambers. In the lower chamber 48 is a lower spring 58 biasing the lower piston 36 against the timing cam 30. The timing cam 30 is connected to an engine rotating shaft, typically the engine camshaft, and provides the basic valve opening and closing times for the various engine valves. In a typical engine, there is one cam for each valve and there is at least one intake and one exhaust valve per cylinder. Since this operation is well known, the camshaft and valves are not shown.

Located in and extending through the legs of the "H" shaped bypass sleeve 42 are at least one inlet means or spaced ports 60 providing passageways for the flow of hydraulic fluid into and out of the lower chamber 48. As illustrated, along the outside diameter of the bypass sleeve 42, and formed between the inner diameter of the bore 16 in the cylinder head 12 and the bypass sleeve, is a circumferential communication passageway 62 functioning to provide a passageway for the flow of hydraulic fluid from the solenoid actuated valve 26 to the ports 60 and also providing for the flow of fluid between the upper chamber 46 and the lower chamber 48.

Located near the top end of the communication passageway 62 are four communication ports 64, 66, 68, 70 connecting the communication passageway 62 with the upper chamber 46. Port 68 is shown with dashed lines to indicate its location on the cutaway (near) wall of the sectional views. Note that the ports 64–70 are axially staggered or spaced sequentially in a portion of the upper chamber 46 along the direction of motion of the upper piston 38.

Figure 2:
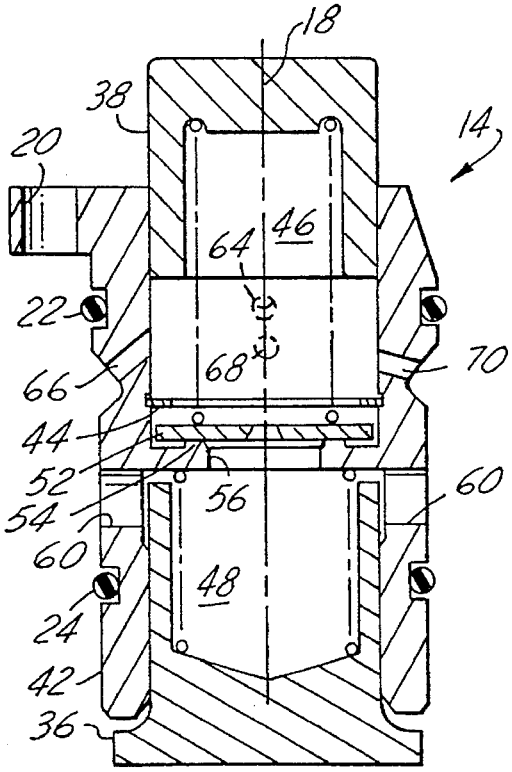
FIG. 2 is a cross-sectional view of the actuator of FIG. 1 showing the valve actuating piston in position for full valve opening.
Figure 3:
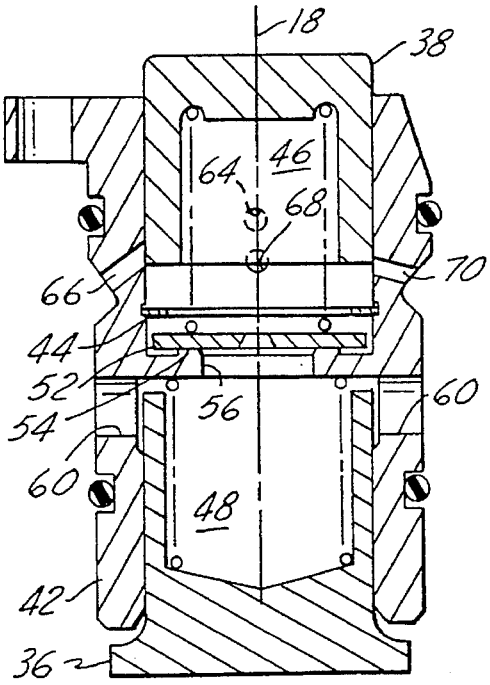
FIG. 3 is a cross-sectional view similar to FIG. 2 but showing the valve actuating piston in a valve closing motion with partial cutoff of the communication ports.
Figure 4:
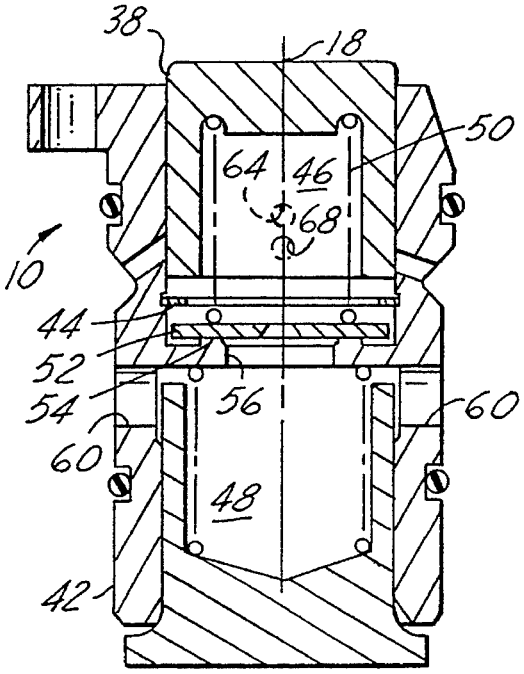
FIG. 4 is a cross-sectional view similar to FIGS. 2 and 3 but showing the valve actuating piston near the valve seating position at the point where full damping of the hydraulic fluid flow begins.

FIGS. 1–4 show pertinent portions of the operation of the lost motion actuator 14. FIG. 1 illustrates zero lift when the lower piston is riding on the base circle of the timing cam 30. FIG. 2 illustrates the movement of the pistons as the lower piston 36 leaves the top of the timing cam and the engine valve is beginning to close. FIG. 3 illustrates the movement of the pistons during phasing in of the damping of engine valve closing. FIG. 4 illustrates the movement of the pistons 36, 38 as the lower piston 36 approaches the base circle of the timing cam 30 and full damping of the valve seating event begins.

Operation of the actuator during valve opening is essentially as described in the previously mentioned U.S. Pat. No. 5,158,048 and need not be repeated here. The sequential spacing of the ports 64–70 has its primary and intended effect during the engine valve closing event which will now be described. It should be understood that the solenoid valve 26 may be open or closed during valve closing so that fluid within the upper chamber may escape by transfer between the upper and lower chambers or through the solenoid valve 26, if open, to the oil supply sump 40.

At the beginning of valve closing, as shown in FIG. 2, downward motion of the upper piston 38 forces fluid out of the upper chamber 46 through the orifice in plate 52 as well as through all of the communication ports 64-70. As the piston moves lower, the ports 64–70 are sequentially cut off, gradually reducing the fluid flow through the communication passageway 62 and forcing an increasing portion of the flow to pass through the orifice. In FIG. 3, ports 64 and 66 are fully closed and the others are partially closed, while in FIG. 4, ports 68 and 70 have also been closed and all the flow thereafter passes through the orifice in plate 52, damping the closing motion of the engine valve during its seating motion.

The sequential cutoff of bypass flow provided by the axially staggered arrangement of the ports 64–70 limits the rate of change of flow through the bypass; that is, the cutoff of bypass flow is made more gradual rather than abrupt as when all the ports are located at the same axial position. The result is that fluid inertia is gradually changed and audible noise due to a hammering effect is reduced or avoided.

While the foregoing description is directed to an embodiment of hydraulic actuator similar to that disclosed in previously noted U.S. Pat. No. 5,158,048, staggered bypass ports or other gradual cutoff means may equally well be used with other forms of actuators such as, for example, that shown in previously noted U.S. Pat. No. 5,216,988. In the latter case, it should be understood that, due to the overhead cam arrangement, the positions of the pistons and chambers are essentially reversed from those previously described. Thus, in U.S. Pat. No. 5,216,988, the cam (actuated) piston and cam chamber are above and surround the valve (actuating) piston and valve chamber. However, the communication ports 60 of U.S. Pat. No. 5,216,988 may be axially staggered to provide the same effect as the staggering of communication ports 64–70 heretofore described. Further, in any of the embodiments contemplated, the number and size of the communication ports may be varied as desired to accomplish the desired results.

Figure 5:
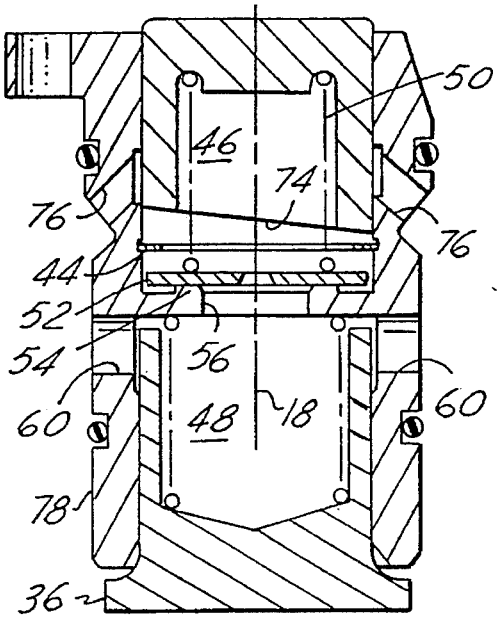
FIG. 5 is a cross-sectional view similar to FIG. 4 but showing an alternative embodiment of hydraulic actuator according to the invention.

Also, if desired, similar results may be obtained by maintaining the communication ports in the same axial plane and varying the shape of the associated piston edge (the lower edge in the first described embodiment) so that it cuts off flow in these ports sequentially. For example, the piston edge could be formed with a helical shape. A variation is shown in FIG. 5 where the piston 72 has a straight slope on its lower edge 74 for use with two or more axially coplanar communication ports 76 in a bypass sleeve 78. Other arrangements of piston edge shape and port location can also be effective.

While the invention has been illustrated by reference to certain embodiments, it should be clear that numerous other changes could be made within the spirit and scope of the invention. Accordingly, it is intended that the invention not be limited to the described embodiments, but that it have the full scope defined by the language of the following claims.

What is claimed is:

1. A lost motion hydraulic actuator for use between a cam and a valve of an internal combustion engine and including a housing defining first and second oppositely opening coaxial cylinders, a first piston reciprocable in the first cylinder and defining a first chamber therein, a second piston reciprocable in the second cylinder and defining a second chamber therein, first biasing means urging the first piston axially outwardly toward operative connection with such cam, second biasing means urging the second piston axially outward toward operative connection with such valve, inlet means for admitting hydraulic fluid into said first chamber, a restrictive orifice continuously interconnecting said chambers for damping valve seating motion during valve closing, one way bypass flow means permitting flow around said orifice from said first chamber to said second chamber during valve opening, and secondary communication means between said chambers including a plurality of ports through said second cylinder and controlled by said second piston, said ports being open during valve lift beyond an initial amount for free flow of fluid between the chambers and said ports being closed by the piston prior to seating of the valve requiring flow from the second chamber to pass through said orifice for damping valve seating, the actuator being characterized in that:

said ports and said second piston are configured to provide sequential closing of the ports during valve closing to limit the rate of change of fluid flow from the second chamber and provide a smooth transition to the inception of damping.

2. The invention as in claim 1 characterized in that:

said ports are axially staggered along said second cylinder for sequential closing by said piston.

3. The invention as in claim 2 characterized in that:

said piston has a sculpted edge for sequentially interacting with said ports.

4. The invention as in claim 1 characterized in that:

said piston has a sculpted edge for sequentially interacting with said ports.

5. A lost motion hydraulic actuator for use between a cam and a valve of an internal combustion engine for controlling the opening and closing of the valve by the cam, said actuator having a free flow path and a parallel restricted flow path between a valve control chamber and a cam controlled chamber, said free flow path being open for discharging fluid from the valve control chamber during a major portion of a valve closing event, but closed prior to valve seating, and said restricted flow path being open, at least during valve seating, to damp the closing speed of the valve during seating, said free flow path comprising a plurality of communication ports closed by a valve driven piston prior to valve seating, said actuator being characterized in that:

transition means are provided to modulate the rate of closing of said free flow path and the resulting rate of change of fluid flow through the free flow path to limit hydraulic shock and noise effects in the actuator.

6. The invention as in claim 5 characterized in that:

said transition means comprise said ports being axially staggered such that the ports are sequentially closed by the piston.

7. The invention as in claim 6 characterized in that:

said transition means further comprise a sculpted edge on said piston for sequentially interacting with said ports.

8. The invention as in claim 5 characterized in that:

said transition means comprise a sculpted edge on said piston for sequentially interacting with said ports.

* * * * *